US005249518A

United States Patent [19]

Abrams

[11] Patent Number: 5,249,518

[45] Date of Patent: Oct. 5, 1993

[54] STRIPPING MECHANISM FOR STRAPPING MACHINE

[75] Inventor: Jack S. Abrams, Arlington Heights, Ill.

[73] Assignee: Signode Corporation, Glenview, Ill.

[21] Appl. No.: 956,071

[22] Filed: Oct. 2, 1992

[51] Int. Cl.[5] ..... B65B 13/06

[52] U.S. Cl. ..... 100/26; 53/589; 100/8

[58] Field of Search ..... 100/8, 25, 26; 53/589

[56] References Cited

U.S. PATENT DOCUMENTS

| | | | |
|---|---|---|---|
| 3,196,779 | 7/1965 | Embree | 100/26 X |
| 4,011,808 | 3/1977 | Aoki et al. | 100/26 |
| 4,244,773 | 1/1981 | Siebeck et al. | 100/26 X |
| 4,661,185 | 4/1987 | Kobiella | 100/26 X |
| 4,781,110 | 11/1988 | Sakaki et al. | 100/26 |
| 5,078,057 | 1/1992 | Pearson | 100/25 |

FOREIGN PATENT DOCUMENTS

| | | | |
|---|---|---|---|
| 3346598 | 10/1984 | Fed. Rep. of Germany | 100/8 |
| 2-57515 | 2/1990 | Japan | 100/26 |
| 2-233314 | 9/1990 | Japan | 100/8 |

*Primary Examiner*—Stephen F. Gerrity
*Attorney, Agent, or Firm*—Thomas W. Buckman; Donald J. Breh

[57] ABSTRACT

In a strapping machine comprising a fixed wall and a movable chute, a mechanism is provided for stripping the strap from the chute. The chute has two sections defining a gap straddled by a bracket connecting the sections. A lever is mounted pivotally on the bracket so as to extend through the gap. A pin in fixed relation to the fixed wall extends through an elongate slot in the lever. The lever is arranged to pivot toward an inoperative position as the chute is moved toward the closed position and to pivot away from the inoperative position and to strip a strap from the space between the flanges of the chute as the chute is moved away from the closed position.

6 Claims, 1 Drawing Sheet

STRIPPING MECHANISM FOR STRAPPING MACHINE

TECHNICAL FIELD OF THE INVENTION

This invention pertains to a stripping mechanism for a strapping machine of a type used to apply a polymeric or metal strap around a load. The mechanism strips a strap from a chute as the chute is moved away from a fixed wall.

BACKGROUND OF THE INVENTION

In a strapping machine of the type noted above, it is common to employ a chute system including a fixed wall and a movable chute, each in an arched configuration. The arched configurations enable the wall and the chute to surround a load being strapped, except where a strapping head is disposed below the load.

Typically, the chute has a generally U-shaped cross-section defining a bight and two generally parallel flanges with a space between the flanges to accommodate a strap being fed along the chute. The chute is movable toward and away from a closed position wherein the flanges bear against the fixed wall. The chute is biased toward the closed position.

Means may be provided, such as solenoid-actuated means, for moving a portion of the chute away from the fixed wall when it is desired to pull a strap from the space between the flanges. Commonly, the portion of the chute that is moved is near the strapping head, below the load. It is known, however, to employ a chute system comprising such a wall and such a chute without such means for moving a portion of the chute.

With a chute system comprising such a wall and such a chute, problems of strap jamming, strap failure, and strap buckling are encountered. In view of such problems, a need has existed for a mechanism that can be readily adapted to such a chute system, for stripping a strap from the chute as the chute is moved away from the wall.

SUMMARY OF THE INVENTION

This invention addresses the aforenoted need and provides a mechanism that can be readily adapted to a chute system comprising a fixed wall and a movable chute, as described above, for stripping a strap from the chute as the chute is moved away from the fixed wall when it is desired to pull a strap from the space between the chute flanges.

In the mechanism provided by this invention, a pin is mounted in fixed relation to the fixed wall, and a bracket is mounted to the chute. Also, the chute has two sections defining a gap straddled by the bracket, which connects the sections. Further, a lever is mounted pivotally on the bracket and is extended through the gap, so as to be pivotable toward and away from an inoperative position wherein the lever does not interfere with a strap in the space between the flanges of the chute.

Thus, the lever is arranged to coact with the pin and to pivot toward the inoperative position as the chute is moved toward the closed position. Also, the lever is arranged to coact with the pin, to pivot away from the inoperative position, and to strip a strap from the space between the flanges of the chute as the chute is moved away from the closed position.

Preferably, the bracket has a plate portion straddling the gap and connecting the sections of the chute and an arm portion, to which the arm is mounted pivotally.

The arm portion may be bifurcated so as to define two spaced lugs, between which the lever is mounted pivotally.

In a preferred embodiment of the mechanism provided by this invention, a bracket is mounted fixedly to the fixed wall, and the pin extends from the fixedly mounted bracket. The pin may be mounted adjustably to the fixedly mounted bracket.

These and other objects, features, and advantages of this invention are evident from the following description of a preferred embodiment of this invention with reference to the accompanying drawings.

DETAILED DESCRIPTION OF PREFERRED EMBODIMENT

Figure 3:
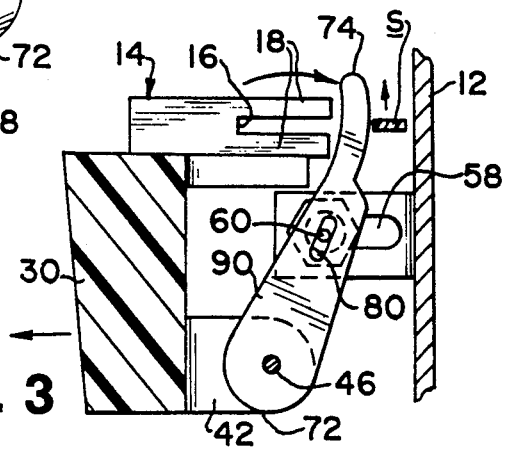
FIG. 3 is a view similar to FIG. 2 but showing the strap, the chute, and other elements of the mechanism in changed positions.

As shown in the drawings, a mechanism 10 constituting a preferred embodiment of this invention is employed in a strapping machine of the type noted above. The strapping machine employs a chute system including a fixed, metal wall 12 and a movable, polymeric chute 14. The wall 12 and the chute 14 have arched configurations, which enable the chute system to extend around the top, two opposite sides, and the bottom of a load (not shown) being strapped, except where a strapping head (not shown) is located beneath the load. The chute system is used to guide a strap S as the strap S is fed around the load, tensioned, joined into a tensioned loop, and severed by the strapping head. While the strap S is being tensioned after the strap S has been fed around the load, as suggested in FIG. 3, the mechanism 10 strips a strap S from the chute as the chute 14 is moved away from the wall 12.

Figure 4:
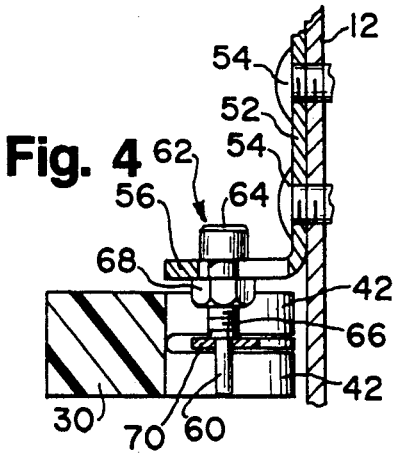
FIG. 4 is a cross-sectional view, as taken along line 4—4 in FIG. 2, in a direction indicated by arrows.

Except for the mechanism 10, the chute system is similar to chute systems employed heretofore in various models of strapping machines sold under the SIGNODE trademark by Illinois Tool Works Inc. of Glenview, Ill., and its predecessor, Signode Corporation. Thus, the chute 14 has a generally U-shaped cross-section defining a bight 16 and two generally parallel flanges 18 with a space between the flanges 18 to accommodate a strap S being fed along the chute 14. Also, the chute 14 is movable toward and away from a closed position wherein the flanges 18 bear against the fixed wall 12. The chute 14 is shown in the closed position in FIGS. 1, 2, and 4 and is shown as moved away from the closed position in FIG. 3.

Figure 2:
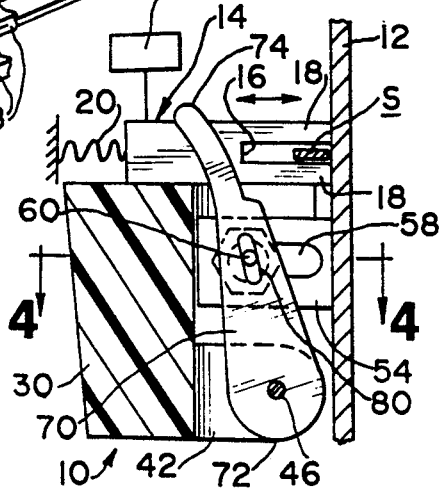
FIG. 2 is a cross-sectional view, as taken along line 2—2 in FIG. 1, in a direction indicated by arrows. A spring and solenoid-actuated means are shown diagrammatically in this view. Also, the chute is shown in a closed position wherein its flanges bear against the fixed wall, which is shown in this view.

Furthermore, the chute 14 is biased toward the closed position by an array of springs 20, one of which is shown diagrammatically in FIG. 2. As shown diagrammatically in FIG. 2, conventional, solenoid-actuated means 22 may be also provided for moving a portion of the chute 14 away from the wall 12 when it is desired to pull a strap S from the space between the flanges 18.

Figure 1:
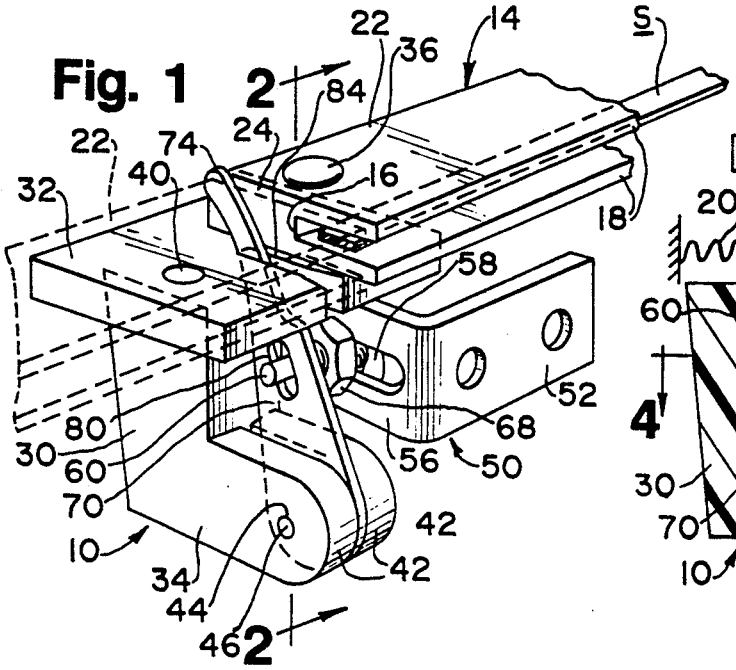
FIG. 1 is a fragmentary, perspective view of two sections of a chute, along with mechanism according to a preferred embodiment of this invention, for stripping a strap from the chute as the chute is moved away from a fixed wall. In this view, one of the sections is shown in dashed lines, so as to reveal details that would be otherwise obscured. The fixed wall is not shown in this view.

For purposes of this invention, the chute 14 has two sections 22 spaced from each other so as to define a narrow gap 24 between the sections 22, as shown in FIG. 1. One of the sections 22 is shown in dashed lines so as to reveal details that would be otherwise obscured. The chute 14 may be made in multiple straight and curved sections, which include the sections 22, each being extruded from a suitable, polymeric material.

The mechanism 10 comprises a bracket 30 having a plate portion 32 and an arm portion 34. The plate portion 32 straddles the gap 24 and connects the chute sections 22. Rivets 36 (one shown) extending through holes (not shown) in the chute sections 22 and through holes 40 in the plate portion 32 of the bracket 30 secure the bracket 30 to the chute sections 22. The arm portion 34 is bifurcated, as shown, so as to define two spaced lugs 42. The spaced lugs 42 have aligned holes 44 (one shown) which accommodate a metal pin 46 having an enlarged, knurled end 48. The bracket 30 is molded from a suitable, polymeric material.

Also, the mechanism 10 comprises a generally L-shaped, metal bracket 50, which is mounted fixedly to the fixed wall 12, near the bracket 30. The bracket 50 has a flange 52 mounted fixedly to the fixed wall 12, via screws 54, and a flange 56 extending outwardly from the fixed wall 12, generally at a right angle relative to the flange 52. The flange 56 has an elongate slot 58 extending lengthwise.

Moreover, the mechanism 10 comprises a metal pin 60 extending from the bracket 50, in fixed relation to the fixed wall 12. A stud 62 (see FIG. 4) with a socket head 64 and a threaded shank 66, from which the pin 60 extends integrally, is provided. The threaded shank 66 extends through the elongate slot 58 in the flange 56 and receives a threaded nut 66, which is threaded tightly onto the threaded shank 66, whereby the pin 60 is mounted adjustably to the bracket 50.

Figure 5:
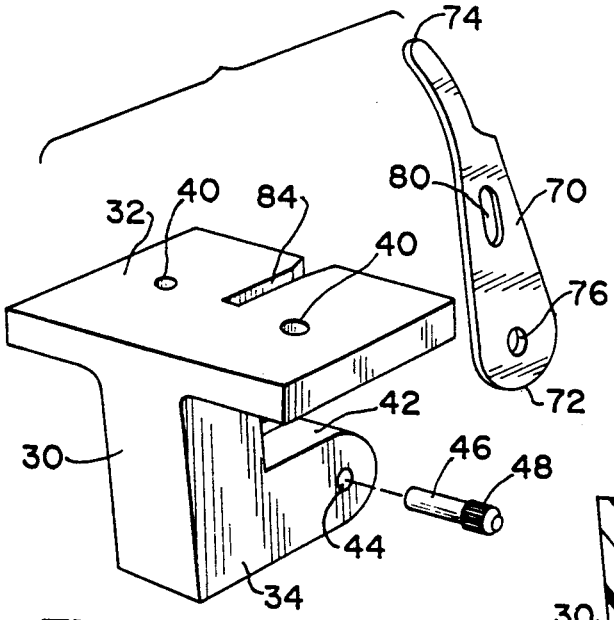
FIG. 5 is an exploded, perspective view of a bracket, a lever, and a pin, as included in the mechanism.

Furthermore, the mechanism 10 comprises a lever 70, which is a thin, blade-like, metal member with a proximal end 72 and a distal end 74. The proximal end is disposed loosely between the spaced lugs 42 of the arm portion 34 of the bracket 30. The pin 46 extends through the hole 44 in one such lug 42, through an aligned hole 76 (see FIG. 5) in the lever 70, near the proximal end 72, and through the hole 44 in the other lug 42. The enlarged, knurled end 48 retains the pin in the hole 44 in one such lug 42, so as to mount the lever 70 pivotally to the bracket 30.

The lever 70 has an elongate slot 80, through which the pin 60 extends so as to allow lost motion between the pin 60 and the lever 70 as the lever 70 is pivoted on the pin 46. Near the distal end 74, the lever 70 has an arcuate edge 82, which faces the fixed wall 12.

The plate portion 32 of the bracket 30 has a slot 84, which is aligned with the gap 24 between the chute sections 22, and which opens toward the fixed wall 12. The lever 70 extends through the gap 24 and through the slot 84, and is pivotable over a limited range of pivotal movement toward and away from an inoperative position wherein the lever 70 does not interfere with a strap S being fed along the chute 14. In the closed position of the chute 14, a strap S being fed along the chute 14 is confined between the bight 16 and the fixed wall 12, and between the chute bight 16 and the fixed wall 12.

Thus, as the chute 14 is moved toward the closed position wherein the flanges 18 bear against the fixed wall 12, the pin 58 engages and slides along an outer margin of the elongate slot 80 so as to pivot the lever 70 toward and away from the inoperative position. Also, as the chute 14 is moved away from the closed position, the pin 58 engages and slides along an inner margin of the elongate slot 80 so as to pivot the lever 70 away from the operative position and so as to strip a strap S from the space between the flanges 18. As shown, the outer margin is the lefthand margin, and the inner margin is the righthand margin. The arcuate edge 82 defines a camming surface, which cams a strap S from the space between the flanges 18.

Advantageously, the lever 70 does not bind regardless of the movement of the chute 14 and regardless of any distortion of the chute 14. Because the gap 24 between the chute sections 22 is narrow, there is virtually no tendency for a strap S being fed along the chute 14, between the flanges 18, to enter the gap 24 at a leading edge (not shown) of the strap S or to buckle into the gap 24.

Preferably, the pin 52 is adjusted on the bracket 50, via the threaded shank 64 extending through the elongate slot 66 in the flange 56 and the threaded nut 68, so that the arcuate edge 82 of the lever 70 ejects a strap S from the space between the flanges 18 of the chute 14 approximately when the chute 14 is moved away from the closed position for a sufficient distance to allow the strap S to pass between the chute 14 and the wall 12 without twisting of the strap S.

Although the chute sections 22 are shown as straight sections, the mechanism 10 can be adapted readily to curved sections (not shown) spaced by a gap like the gap 24, merely by providing the plate portion 32 of the bracket 30 with a suitable curvature.

Various modifications may be made in the preferred embodiment described above without departing from the scope and spirit of this invention.

I claim:

1. In a strapping machine comprising a fixed wall and a movable chute, the chute having a generally U-shaped cross-section defining a bight and two generally parallel flanges with a space between the flanges to accommodate a strap being fed along the chute, the chute being movable toward and away from a closed position wherein the flanges bear against the fixed wall, the chute being biased toward the closed position, a mechanism for stripping the strap from the chute as the chute is moved from the closed position, the mechanism comprising a pin mounted in fixed relation to the fixed wall, a bracket mounted to the chute, the chute having two sections defining a gap straddled by the bracket, which connects the sections, and a lever mounted pivotally on the bracket so as to extend through the gap, the lever having an elongate slot, through which the pin extends, the lever being pivotable on the bracket toward and away from an inoperative position wherein the lever does not interfere with a strap in the space between the flanges of the chute, the lever being arranged to pivot toward the inoperative position as the chute is moved toward the closed position, the lever being arranged to pivot away from the inoperative position and to strip a strap from the space between the flanges of the chute as the chute is moved away from the closed position.

2. The mechanism of claim 1 wherein the bracket has a plate portion straddling the gap and connecting the sections of the chute and an arm portion, to which the lever is mounted pivotally.

3. The mechanism of claim 2 wherein the arm portion is bifurcated so as to define two spaced lugs, the lever being mounted pivotally between the spaced lugs.

4. The mechanism of claim 1 further comprising a bracket mounted fixedly to the fixed wall, the pin extending from the fixedly mounted bracket.

5. The mechanism of claim 4 wherein the pin is mounted adjustably to the fixedly mounted bracket.

6. In a strapping machine comprising a fixed wall and a movable chute, the chute having a generally U-shaped cross-section defining a bight and two generally parallel flanges with a space between the flanges to accommodate a strap being fed along the chute, the chute being movable toward and away from a closed position wherein the flanges bear against the fixed wall, the chute being biased toward the closed position, a mechanism for stripping the strap from the chute as the chute is moved from the closed position, the mechanism comprising a first pin mounted in fixed relation to the fixed wall, a bracket mounted to the chute, a second pin mounted in fixed relation to the bracket, the chute having two sections defining a gap straddled by the bracket, which connects the sections, and a lever extending through the gap, the lever having a first aperture, through which the first pin extends, the lever having a second aperture, through which the second pin extends, one of the first and second apertures being elongate so that the lever is pivotable toward and away from an inoperative position wherein the lever does not interfere with a strap in the space between the flanges of the chute, the lever being arranged to pivot toward the inoperative position as the chute is moved toward the closed position, the lever being arranged to pivot away from the inoperative position and to strip a strap from the space between the flanges of the chute as the chute is moved away from the closed position.

* * * * *